US005567185A

United States Patent [19]

Henderson et al.

[11] Patent Number: 5,567,185

[45] Date of Patent: Oct. 22, 1996

[54] ELECTRICAL CONNECTOR AND METHOD OF MAKING SAME

[75] Inventors: Kevin G. Henderson, Gastonia, N.C.; Timothy A. Jones, Spartanburg; Jeffrey C. Howland, Inman, both of S.C.; Robert W. Brush, Jr., Rocky Mount, N.C.; Phil B. Parker, Gowensville, S.C.

[73] Assignee: Thomas & Betts Corporation, Memphis, Tenn.

[21] Appl. No.: 326,177

[22] Filed: Oct. 19, 1994

[51] Int. Cl.[6] ..... H01R 13/40

[52] U.S. Cl. ..... 439/733.1; 439/751

[58] Field of Search ..... 439/741, 751, 439/82, 83, 733, 595, 374, 636, 637

[56] References Cited

U.S. PATENT DOCUMENTS

| | | | |
|---|---|---|---|
| 3,122,604 | 2/1964 | Cook et al. | 174/51 |
| 3,535,673 | 10/1970 | Maltais et al. | 339/95 |
| 3,686,609 | 8/1972 | Hansen | 339/14 |
| 4,050,777 | 9/1977 | Peters | 350/292 |
| 4,717,354 | 1/1988 | McCleerey | 439/751 |
| 4,909,754 | 3/1990 | Paradis | 439/751 |
| 5,131,872 | 7/1992 | Consoli et al. | 439/751 |
| 5,259,795 | 11/1993 | Yamada et al. | 439/751 |

FOREIGN PATENT DOCUMENTS 2198599 1/1988 United Kingdom .

*Primary Examiner*—David L. Pirlot
*Attorney, Agent, or Firm*—Michael L. Hoelter; Salvatore J. Abbruzzese

[57] ABSTRACT

A method for making an electrical connector comprises the steps of configuring a housing and contact members such that the contact members may assume positions in the housing which are variable for each contact member and of assembling the contact members in the housing such that they assume positions therein giving rise to contact member coplanarity. An electrical connector so made comprises a housing defining contact member receiving channels and contact members resident in the channels, the contact members defining contact portions and contact member retaining means, the housing being configured to permit variable positioning of said contact member retaining means therein, whereby contact member contact portions may be coplanarly positioned irrespective of warp present in the housing.

13 Claims, 4 Drawing Sheets

ELECTRICAL CONNECTOR AND METHOD OF MAKING SAME

BACKGROUND OF THE INVENTION

1. Field of the Invention

This invention relates generally to electrical connectors and pertains more particularly to simplified and less expensive methods of manufacturing electrical connectors.

2. Background of the Invention

A widespread practice in electrical connector manufacture is to precisely dispose a plurality of contact members in positions mutually desired in the ultimate connector housing and then to precision mold the housing about the contact members. Given the precision in both the contact member disposition in the mold and in the precision of the mold itself, coplanarity of contact member contact portions relative to the housing in the ultimate connector is satisfactorily achieved.

A simpler and less costly practice in use is molding the housing and then inserting contact members in contact member receiving channels in the housing.

A problem, however, attends achieving coplanarity of contact member contact portions, i.e., where the preformed housing exhibits warping or bowing. Thus, the housing typically defines stop positions for inserted contact members. Where warping or bowing is at hand, the stop positions are not coplanar and the inserted contact members accordingly do not exhibit coplanarity.

SUMMARY OF THE INVENTION

The present invention has as its primary object the achievement of contact member coplanarity in the face of warping or bowing in preformed connector housings.

In attaining this and other objects, the invention provides a method for making an electrical connector comprising the steps of configuring a housing and contact members such that the contact members may assume positions in the housing which are variable for each contact member and of assembling the contact members in the housing such that they assume positions therein giving rise to contact member coplanarity.

An electrical connector in accordance with the invention comprises a housing defining contact member receiving channels and contact members resident in the channels, the contact members defining contact portions and contact member retaining means, the housing being configured to permit variable positioning of said contact member retaining means therein, whereby contact member contact portions may be coplanarly positioned irrespective of warp present in the housing.

The foregoing and other objects and features of the invention will be further understood from the following detailed description of preferred embodiments thereof and from the drawings, wherein like reference numerals identify like components throughout.

DETAILED DESCRIPTION OF THE PREFERRED EMBODIMENTS

Figure 1:
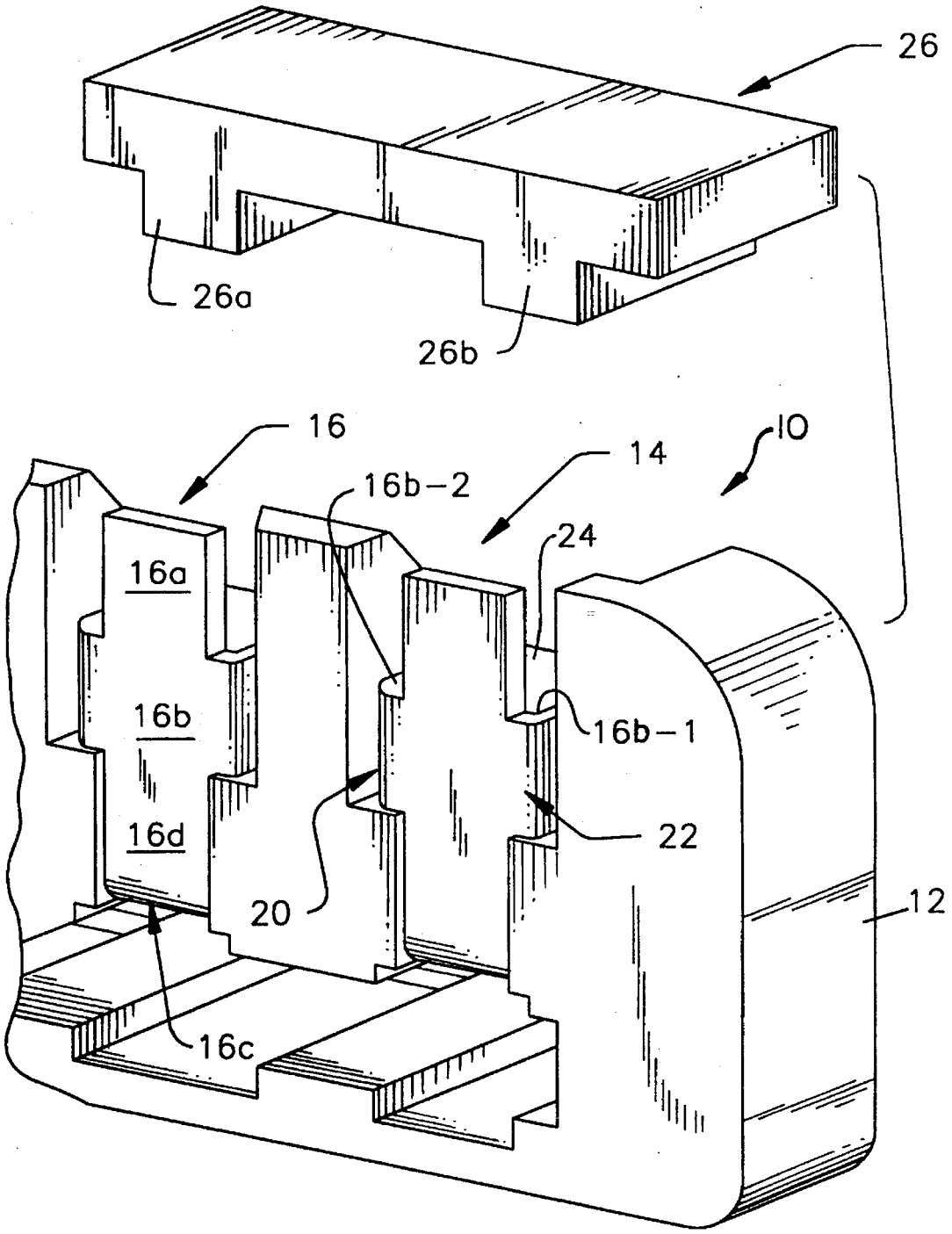
FIG. 1 is a rear perspective partial showing of an electrical connector in accordance with the invention.

Referring to the partial showing of FIG. 1, connector 10 includes housing 12 comprised of electrically nonconductive material. Housing 12 defines a plurality of channels 14 opening into the upper surface of the housing, each channel being adapted for the receipt of contact member 16.

Contact members 16 are electrically conductive and are formed with upper contact portion **16*a*, wing portion 16*b*, having wings 16*b*-1 and 16*b*-2, lower contact portion 16*c* and connecting portion 16*d*, which connects wing portion 16*b* and lower contact portion 16*c*. Housing 12 is open rearwardly for receipt of contact members 16**.

Slots 20 and 22 extend fully through housing 12, for purposes below discussed.

Figure 2:
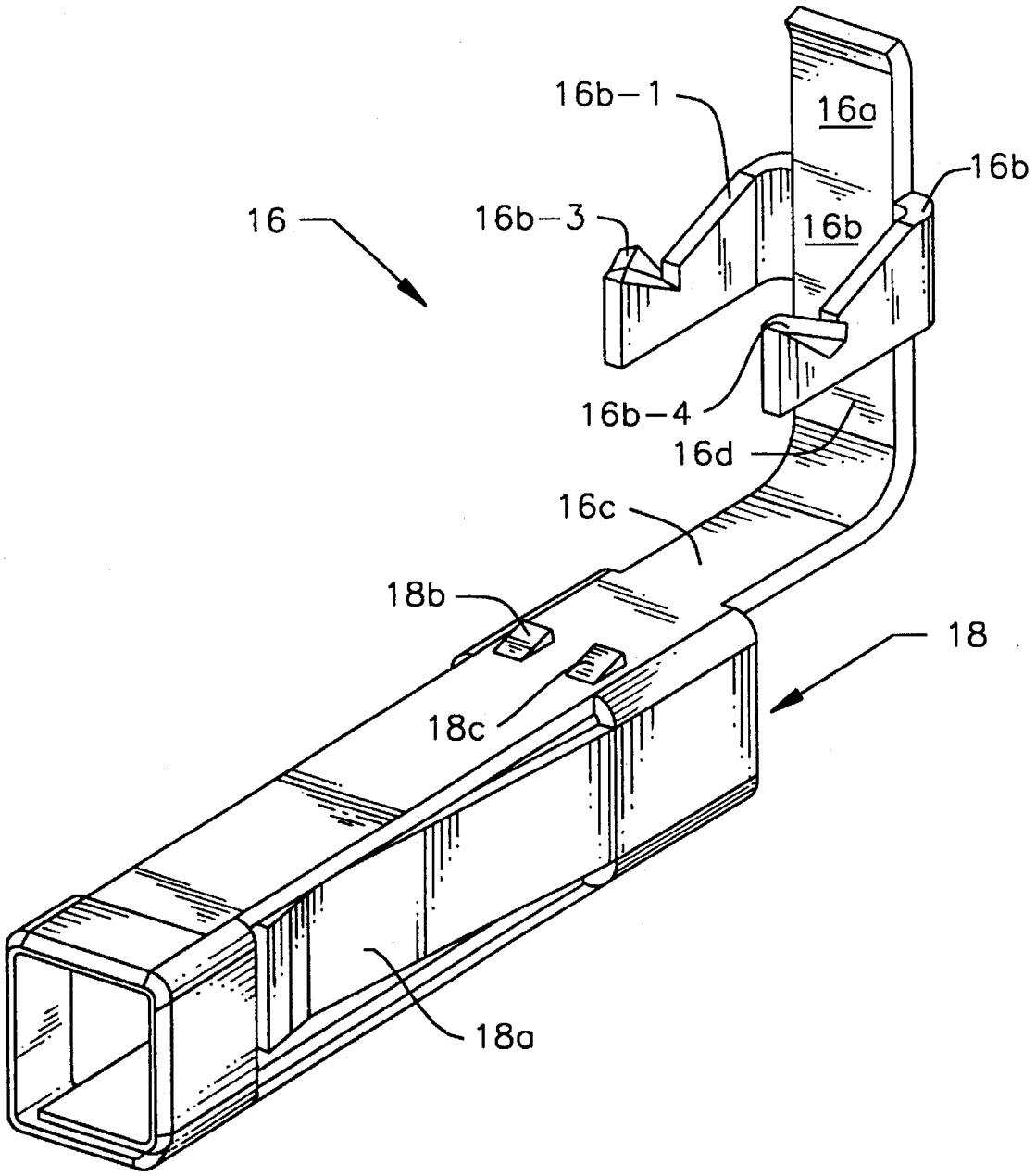
FIG. 2 is a perspective view of a contact member of the FIG. 1 connector.
Figure 3:
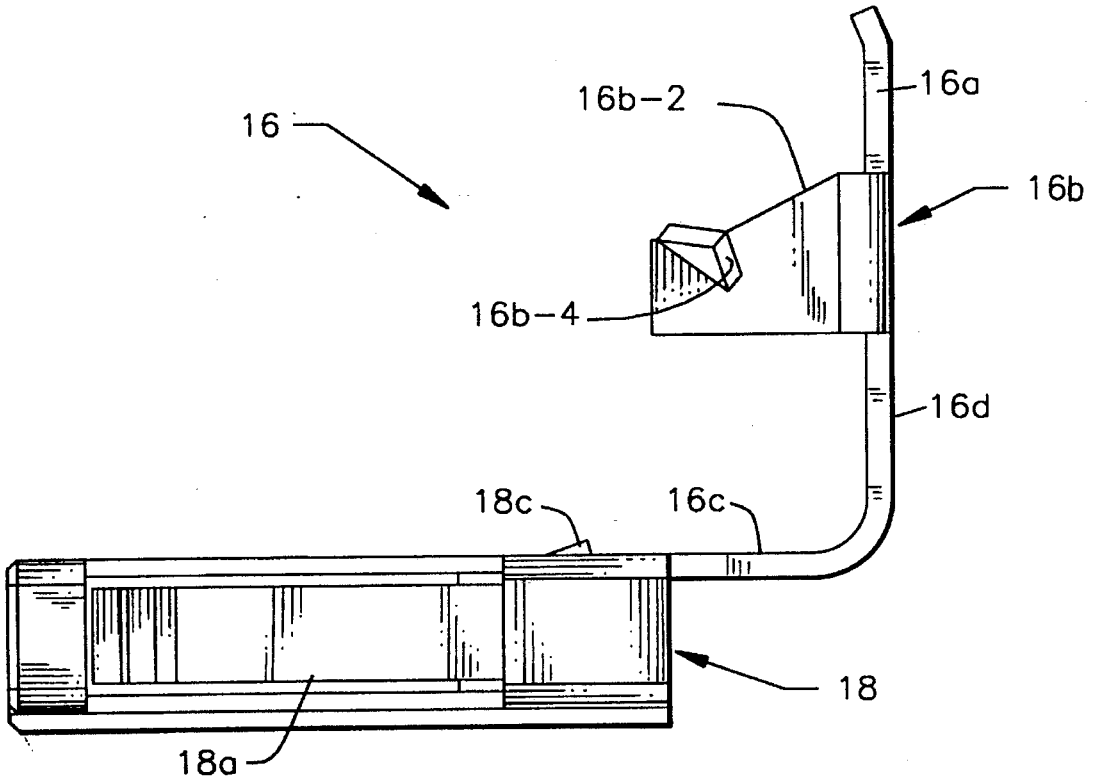
FIG. 3 is a side elevation of the contact member of FIG. 2.

Referring to the showing of contact member 16 in FIGS. 2 and 3, details thereof not seen in FIG. 1 are illustrated. Wings **16*b*-1 and 16*b*-2 will be seen to progress through arcuate sections to extend orthogonally of the plane of the contact member, tapering downwardly to free ends which support retention barbs 16*b*-3 and 16*b*-4, which extend sidewardly outwardly of the planes of wings 16*b*-1 and 16*b*-2. Contact member portion 16*c* supports female contact member 18, one of its two mating contacts being indicated at 18*a*. Portion 16*c* and contact member 18 are mutually secured as indicated at 18*b* and 18*c***.

Figure 4:
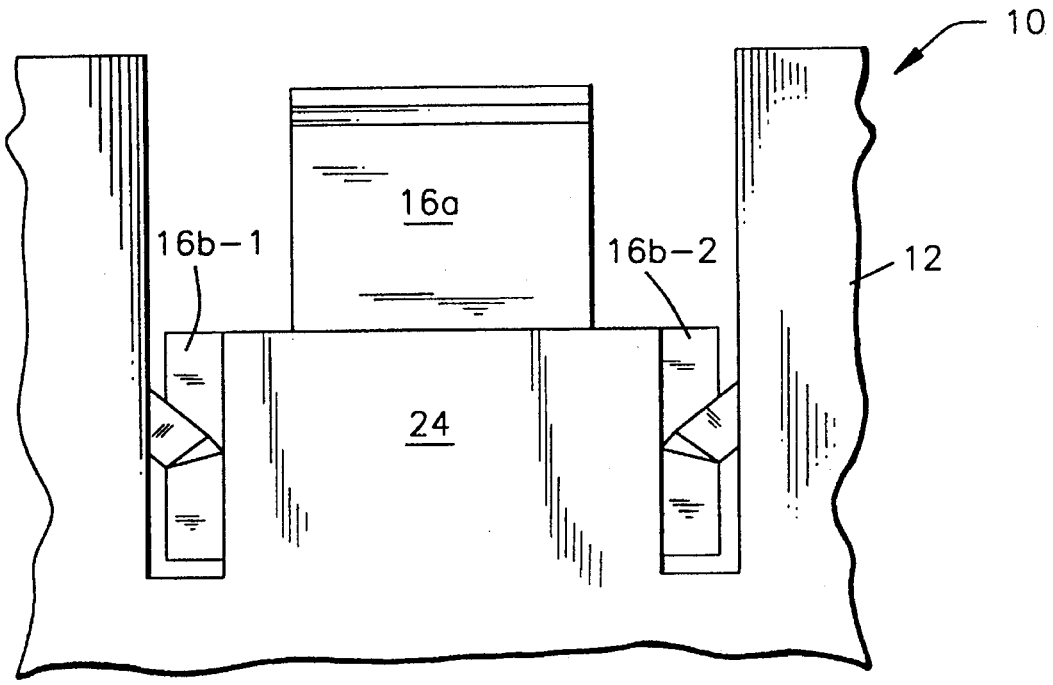
FIG. 4 is a partial front elevation of the FIG. 1 connector.
Figure 5:
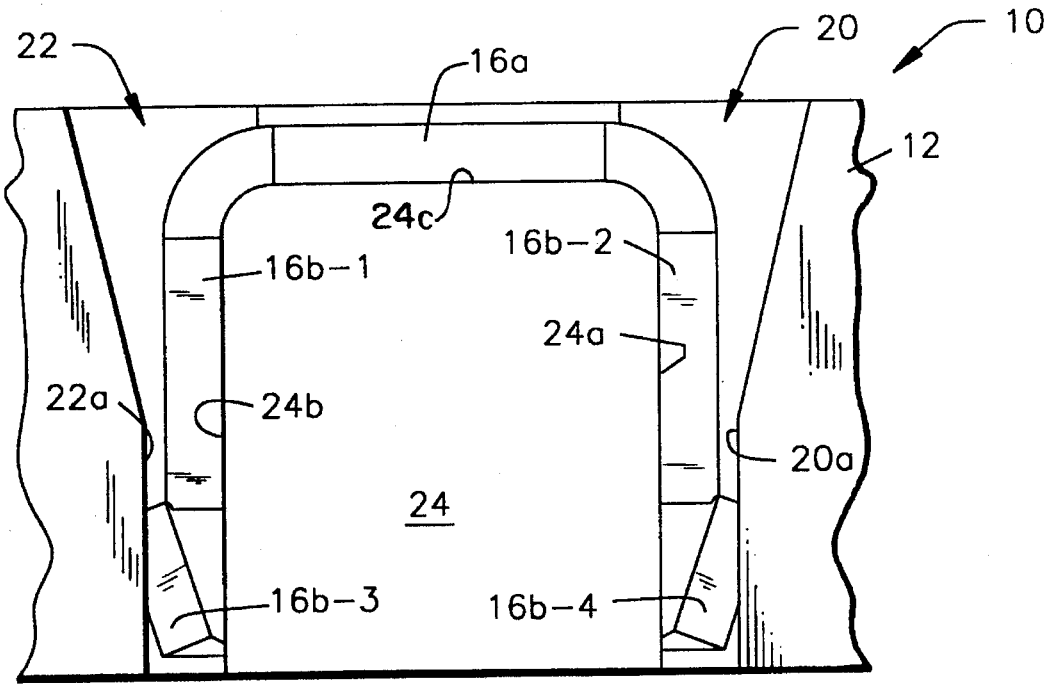
FIG. 5 is a plan view of FIG. 4.

Turning to FIGS. 4 and 5, slots 20 and 22 extend from wide openings at the rear of housing 12 to narrow width portions adjacent the front of housing 12, where they are bounded sidewardly by housing surface **22*a* and housing ledge surface 24*a* in the case of slot 20 and by housing surface 22*b* and housing ledge surface 24*b* in the case of slot 22**.

In assembling connector 10, use is made of contact displacement plate 26 (FIG. 1), which has lower positioning fingers **26*a*. Contact members 16 are loaded into housing 12 rearwardly into channels 14 with wings 16*b*-1 and 16*b*-2 inserted into slots 20 and 22 at elevations such that all contact members can be engaged commonly atop contact portions 16*a* by plate fingers 26*a*. With the contact members so retentively seated in the housing, plate 26 is placed such that plate fingers 26*a* engage the tops of contact portions 16*a*** and the plate is advanced downwardly.

In the course of such plate movement, contact members 16, while retained in housing 12 by retention barbs **16*b*-3 and 16*b*-4, are forced further downwardly. Based on the geometry at hand, all tops of contact portions 16*a* are coplanar in disposition. The step of plate movement is such that plate 26 does not engage housing 12**, whereby any warp or bowing in the housing does not affect coplanarity of the contact members.

Various changes in structure to the described apparatus and modifications in the described practices may evidently be introduced without departing from the invention. Accordingly, it is to be understood that the particularly disclosed and depicted embodiments are intended in an illustrative and not in a limiting sense. The true spirit and scope of the invention are set forth in the following claims.

What is claimed:

1. An electrical connector comprising a molded housing of electrically insulative material which is subject to warpage during molding, and contact members resident in said housing, said contact members defining contact portions and means for retaining said contact members in said housing, said means for retaining said contact members in said housing, said housing and contact member retaining means being cooperatively configured to permit variable positioning of said contact member within said housing, whereby said contact member contact portions are coplanarly positionable in said housing irrespective of warp present in the housing.

2. The electrical connector claimed in claim 1, wherein each said contact member contact portion is at a free end of said contact member, said contact member further including a wing portion distal from said contact member free end, said wing portion supporting said contact member retaining means at free ends thereof.

3. The electrical connector claimed in claim 2, wherein said housing defines a plurality of channels, a distinct one of said contact members residing in each said channel, and first and second slots in communication with each said channel, said contact member retaining means being resident in said first and second slots and retentively engaged with a side wall of each of said first and second slots.

4. The electrical connector claimed in claim 3, wherein said contact member wing portion includes first and second wings, said first and second wings being resident respectively in said first and second slots.

5. The electrical connector claimed in claim 4, wherein said contact member retaining means comprises first and second barb members at ends of said first and second wings, respectively.

6. The electrical connector claimed in claim 2, wherein each said contact member includes a further contact portion and a connecting portion connecting said further contact portion with said wing portion thereof.

7. The electrical connector claimed in claim 6 wherein said further contact portion is disposed orthogonally to said connecting portion.

8. An electrical connector, comprising:

(a) a housing comprised of electrically insulative material, said housing defining a plurality of channels opening into a first surface of said housing, each said channel being bounded by a ledge situated in said housing interiorly of said first housing surface and by opposed first and second interior housing walls extending from said housing first surface to a housing second surface opposite said housing first surface, said housing further defining first and second slots communicating with each said channel, said slots extending fully through said housing and opening into third and fourth housing surfaces, each said slot being bounded in part by one of said first and second interior housing walls and by third and fourth housing interior sidewalls extending to said ledges; and (b) a plurality of electrical contact members individually disposed in said channels and in the first and second slots communicating therewith, each said contact member having a contact portion at one end thereof, first and second wings extending substantially perpendicularly from opposed sides of said contact portion and respectively into said first and second slots for said channel, and first and second contact member retention portions at respective ends of said first and second wings and in interference relation respectively with said first and third housing interior sidewalls and with said second and fourth housing interior sidewalls.

9. The electrical connector claimed in claim 8, wherein said housing defines a further slot for each said channel, said further slot opening into said housing third surface and extending from said ledge to said housing second surface.

10. The electrical connector claimed in claim 9, wherein each said contact member defines further contact portion accessible at said housing second surface and a connecting portion extending from said first-mentioned contact portion to said further contact portion, said connecting portion being resident in said further slot.

11. An electrical connector comprising:

a molded housing of electrically insulative material which is subject to warpage during molding, the housing including a plurality of channels therein, each said channel having first and second slots in communication therewith; and contact members each slidably insertable into respective housing channels including an upper contact portion, means for retaining said contact members in said respective housing channels and associated slots, a lower contact portion and a connection portion connecting the retaining means to the lower portion, the lower portion being disposed orthogonally to said upper portion, wherein the housing and contact members in combination are cooperatively configured to permit variable positioning of said contact member retaining means within the housing so that the upper contact portions are capable of being coplanarly positioned in the housing irrespective of warp present in the housing.

12. The electrical connector claimed in claim 11, wherein said contact member includes a wing portion orthogonal to and distal from said upper contact portion, said wing portion supporting said contact member retaining means at free ends thereof.

13. An electrical connector claimed in claim 12, wherein said contact member retaining means is resident in said first and second slots and retentively engaged with a sidewall of each of said first and second slots.

* * * * *